United States Patent [19]

Vandersteen

[11] Patent Number: 5,073,948

[45] Date of Patent: Dec. 17, 1991

[54] MIDRANGE LOUDSPEAKER DRIVER

[76] Inventor: Richard J. Vandersteen, 2017 Mayfair Dr., Hanford, Calif. 93230

[21] Appl. No.: 418,506

[22] Filed: Oct. 10, 1989

[51] Int. Cl.[5] ..... H04R 25/00

[52] U.S. Cl. ..... 381/192

[58] Field of Search ..... 181/171, 172, 157, 164; 381/188, 194, 192

[56] References Cited

U.S. PATENT DOCUMENTS 2,722,991 11/1955 Carbonneau ..... 181/171

2,998,496 8/1961 Hassan ..... 381/194

3,150,441 9/1964 Kloss ..... 381/188

4,256,198 3/1981 Kawakami et al. ..... 181/171

*Primary Examiner*—Forester W. Isen

*Assistant Examiner*—M. Nelson McGeary, III

*Attorney, Agent, or Firm*—Robert B. Block

[57] ABSTRACT

A midrange loudspeaker driver of the cone diaphragm and magnetic coil type having a reflection free zone immediately behind the diaphragm and within the driver to significantly reduce internal reflections of the diaphragm's rear waves resulting in improved clarity and transparency of sound.

11 Claims, 2 Drawing Sheets

MIDRANGE LOUDSPEAKER DRIVER

BACKGROUND OF THE INVENTION

This invention relates to loudspeakers for audiophile applications, and, more particularly, to a low distortion cone type, midrange, moving coil, loudspeaker driver.

The quality of music reproduction by a loudspeaker is usually stated in terms of frequency and phase linearity, as well as dispersion and axial response. Quality moving coil loudspeakers systems have traditionally divided the audible frequencies between two or more driver units, each particularly suited to producing its assigned frequency range. For midrange frequencies extending from 250 Hz to 6 kHz a cone type driver with a moving diaphragm of about 5 inches or less in diameter has been found suitable and is now, more or less, an industry standard. Despite the fact that such loudspeakers have been made with a high degree of perfection in respect to the desired specifications of frequency response, phase linearity, dispersion, and axial response, they nevertheless lack the clarity which may be found in electrostatic planar speakers, particularly over the midrange of frequencies. It is believed that these limitations are a result of the midrange driver design itself.

There is, therefore, a need for an improved cone type loudspeaker driver for use in the midrange frequencies which will provide greater clarity and transparency of sound.

SUMMARY OF THE INVENTION AND OBJECTS

It is the general object of the present invention to provide a cone type moving coil midrange loudspeaker driver which will provide greater clarity and transparency of sound, even beyond that which is measured by the current standards of frequency response, phase linearity, dispersion and axial response.

It is a further object of the present invention to provide a cone type midrange loudspeaker driver of the above character that exhibits significantly less perceived distortion and audible sonic degradation.

In analyzing present cone type moving coil midrange loudspeaker designs there are certain constraints which are mandatory in any design due to the nature of the layout itself. Thus, the magnet must be of sufficient size and power to provide adequate efficiency and to maintain moving mass control. The basket must be rigid enough to keep the driver components in proper alignment. To accomplish these design aspects, present cone type moving coil midrange loudspeakers use basket and magnet structures to support them that occupy a substantial amount of the projected two-dimensional area of the moving diaphragm as viewed from the front or rear of the driver.

The present invention is predicated on the realization that both the front and the rear of the diaphragm generate sound waves and that the rear sound wave, while not focused in the same way, or thought of as important in projecting sound in the forward direction, is, nevertheless, nearly as substantial as the front wave and can make a negative contribution to sound quality. Now, it is only the front wave of a midrange speaker which is desired to be projected to the listener. While the rear wave is utilized in some speakers, it is not needed in a midrange design. It has been found that, if the rear wave is reduced, if every effort is made to eliminate the rear wave and all of its reflections, the clarity and transparency of the sound is markedly improved. It has been found that a significant negative aspect of current cone type midrange loudspeakers results from internal reflections of the rear waves from within the driver itself.

In conventional drivers, a basket and magnet structure is used to mount the diaphragm and electromagnet. These structures present comparatively large areas which reflect rearwardly propagated waves directly back to and through the speaker diaphragm. The reflected wave strikes the moving diaphragm and either passes through the moving diaphragm and into the listening area or is partially absorbed by the diaphragm. The absorbed energy causes the moving diaphragm to vibrate in a manner not dictated by the input signal. The diaphragm may even reflect the reflected signal rearwardly back for continued reflections.

The portion of the reflected rear wave that passes through the moving diaphragm and enters the listening area is not in the same phase or time frame as the original signal and, therefore, is no more than pure distortion. Although lower in level than the original signal due to energy loss, the reflected wave is often loud enough to cause the overall sound quality at the position of the listener to become confused and distorted. This is usually a direct cause of loss of clarity and transparency to the listener. The reflected wave also has components which may be said to have been diffracted and can represent an even greater distortion. These diffracted components are included within the term "reflected", as used herein.

The portion of the reflected rear wave that is absorbed by the moving diaphragm also vibrates the diaphragm, causing phase and time distortions as well as amplitude errors in the loudspeaker's forward responses.

The portion of the rear wave that is reflected back by the diaphragm may once again be reflected by the magnet and basket structures so as to contribute to time and amplitude distortions which are even more severe, although of less amplitude.

Accordingly, it is an object of this invention to provide a cone type moving coil midrange loudspeaker that exhibits significantly less distortion and audible sonic degradation due to reflected rear waves than presently available designs.

It has been now found in accordance with the present invention that, by suitable design and construction and control of the size of the components of the basket structure and of the magnet structure, it is possible to create a reflection free zone in the region immediately behind the diaphragm, and within the driver itself, and thereby to significantly reduce internal reflections of the moving diaphragm's rear waves from within the structures within the speaker driver, with the result that the clarity and transparency of the sound is remarkably improved.

It is a further object of the invention to provide a loudspeaker driver of the above character which eliminates internal sound reflections of the rearward wave from passing back toward, into or through the speaker diaphragm with resulting distortions travelling in the direction of the forward wave.

In accordance with the present invention, several features of the speaker driver design have been modified in order to eliminate internal reflections from the speaker involving three structures. These include, first, the basket structure itself; second, the magnet structure;

and third, the zone of space between the diaphragm and the basket and magnet structures. An alternative, but less desirable structure employs sound absorbers and dispersers mounted within the speaker driver itself.

It has been found that a redesign of the basket structure and the magnet structure can reduce the projected area as seen by the rear wave from values of 80% or more, as found in conventional designs, to values well below 50%. This serves to eliminate the internal reflecting wave to a substantial degree. Further, by designing the basket arms so that reflections are directed away from the diaphragm also reduces the unwanted rear wave reflection.

Redesign of the magnet structure has been undertaken, in accordance with this invention, in a way which elongates the magnet structure while reducing its overall diameter so that its projected area is also substantially reduced. By elongating the magnet structure it is possible to move the arms of the supporting basket structure rearwardly for a substantial distance before converging them in a sloping manner towards the magnet support flange. In this way, the support arms are removed from the immediate diaphragm environment. Further the arms are be made dramatically smaller in cross-section, and particularly in the effective cross-section that would reflect sound in the forward direction.

The sum of these design features achieves a driver design which provides an absolutely non-reflective zone immediately behind the diaphragm which is bounded to the rear with structure which is far less than 80% of the projected area of the diaphragm and is in fact well under 50% of the projected area. This zone is extensive, having a depth about as large as the diameter of the diaphragm, in which essentially no reflective surfaces exist. Such reflective surfaces of the basket which necessarily must exist, reflect in directions other than back towards the diaphragm itself.

While the magnet structure itself can only be reduced to a certain degree, it must be realized that the internal reflections within the inside of the magnet can be eliminated by the use of a sound absorber over the central portion of the diaphragm so that it is only the differential area of the magnet which is larger than the central area of the diaphragm which can causes reflections of the rear wave.

As to such reflections from the magnet structure itself which remain or which because of limitations in the basket and magnet design are necessarily present, these are eliminated in accordance with the present invention by employing an alternative structure in the form of internal absorptive or dispersive material which surrounds the rear side of the diaphragm, not in contact therewith, but lying within and supported on the basket structure. Such a structure may be supported on the arms and will serve to disperse and absorb rearwardly directed waves so that the reflection by the basket and magnet structures is reduced.

The aforementioned several measures are preferably distinct, but can be taken together to collectively reduce the internal reflections to a very low value.

These and other objects and features of the invention will become apparent from the following detailed description when taken in conjunction with the accompanying drawings, which:

DETAILED DESCRIPTION OF THE PREFERRED EMBODIMENTS

Figure 1:
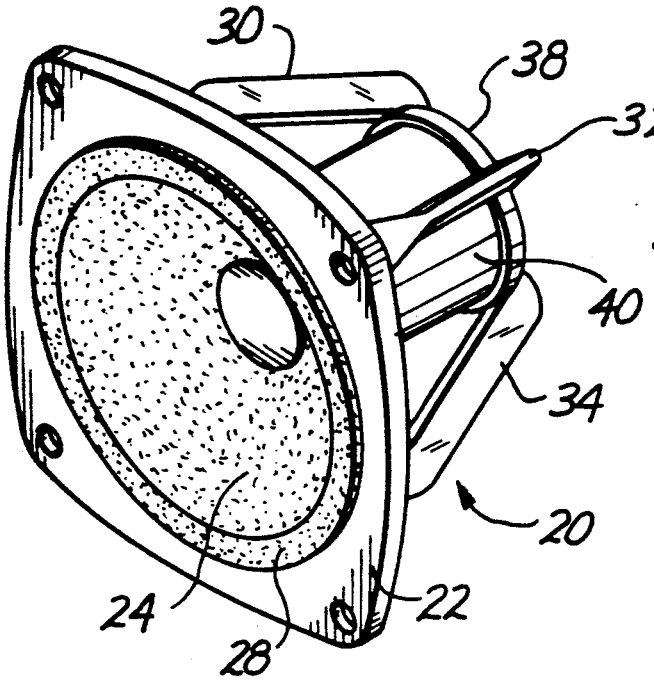
FIG. 1 is a perspective view of a midrange loudspeaker driver constructed in accordance with the present invention in which a reflection free zone is created behind the diaphragm and internally within the driver.
Figure 2:
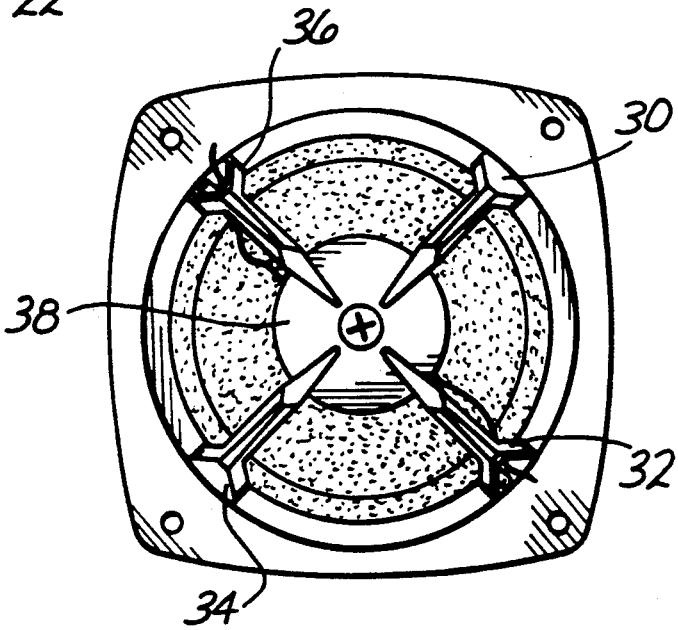
FIG. 2 is a rear elevational view of the driver of FIG. 1.
Figure 3:
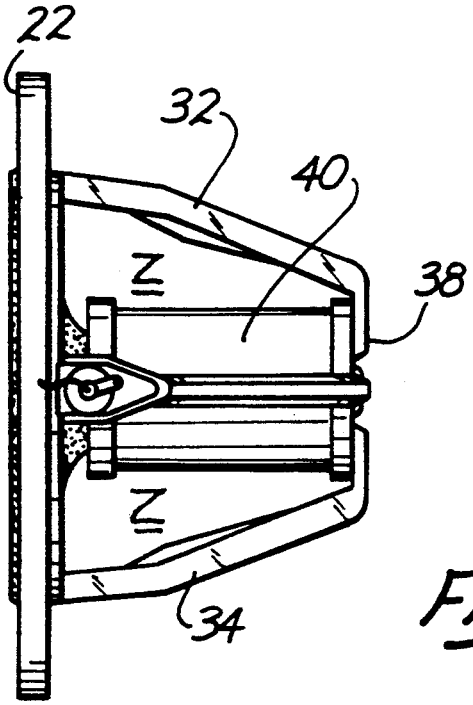
FIG. 3 if a side elevational view of the driver in FIG. 1 showing the relative projection of the basket and magnet structure to the diaphragm area.

Referring to FIGS. 1 through 3 there is shown in detail a loudspeaker constructed in accordance with the present invention which includes generally a frame or basket 20 including a front flange 22 having a recess therein for mounting the diaphragm 26. The diaphragm 26 is rigid but is provided with an outer peripheral elastic suspension 28 between the flange and the rigid central section so that the diaphragm may move relatively freely back and forth. The basket is provided with a plurality of arms 30, 32, 34, 36 which extend rearwardly and connect to a magnet mounting flange 38 for supporting a magnet 40 as a rigid assembly. The magnet includes a concentrated source rare earth magnet at its base operating through a pole piece extending forwardly through a voice coil 44 provided on the diaphragm. The internal construction of the diaphragm voice coil and magnet gaps are relatively conventional type and need not be described in detail.

The basket 26 and magnet 40 are specially designed and constructed in accordance with the present invention with means for eliminating internal reflections from within the driver structure from being directed backward through the diaphragm 26. To this end both the basket 20 and the magnet 40 are elongated toward the rear of the driver and the magnet diameter is reduced together with the associated flange 38 and arms 30-36 so as to open up a reflection free zone between the diaphragm and these structures. As will be discussed, the magnet diameter is reduced as much as possible and the reflective areas previously presented by the basket arms are eliminated.

The magnet 40 itself has been redesigned with a diameter which is greatly reduced and is provided with an elongate construction to accommodate the need for extending the basket arms rearwardly away from the diaphragm structure for a substantial distance. When taken together this opens up the area behind the loudspeaker to create a reflection free zone Z for a substantial distance to the rear of the diaphragm wherein there is an absence of reflecting structure therein.

Additional measures, using shaped absorbers in accordance with the present invention, as will be disclosed hereinafter, can be used in connection with the modified structure, or by themselves, to also eliminate internal reflections.

The basket 26 is shown in detail in FIG. 3 and incorporates the basic design and construction necessary for eliminating internal reflections. Thus, the arms 30, 32, 34, 36 are extended rearwardly for a substantial distance away from the diaphragm before converging at an angle which is non-reflective toward the diaphragm and into a connection with the rear magnet flange 38.

More particularly, the sections 30*a*, 32*a*, 34*a*, 36*a* of the arm are firstly extended very nearly directly away from the flange in a rearward direction before bending at 30*b*, 32*b*, 34*b*, 36*b* toward the rear flange. The arms themselves are constructed with more nearly a square cross-section with stiffening ribs 30*c*, 32*c*, 34*c*, 36*c* provided to form a generally stiffened section in the region where the arms bend towards the rear flange. Lastly the basket structure is made of a single piece die cast construction so that the rigidity may be maintained while reducing the cross-section.

In a preferred embodiment the basket is made of die-cast aluminum magnesium alloy but it could be made of plastic such as nylon or stamped steel.

Figure 4:
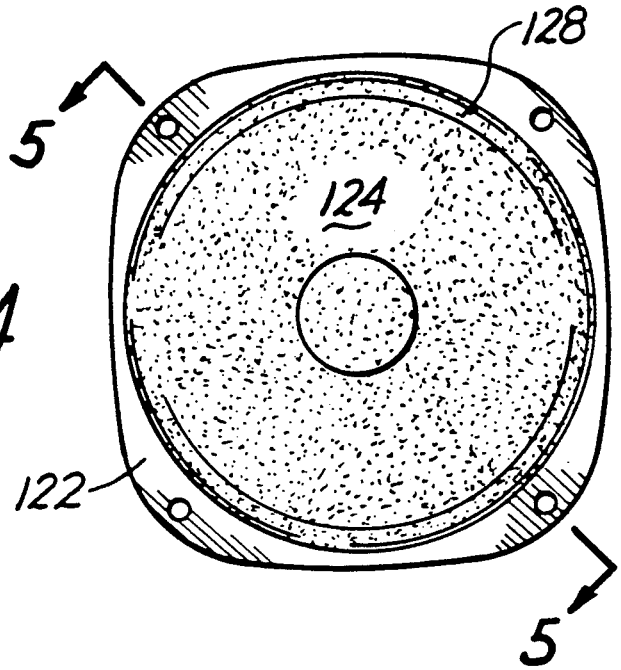
FIG. 4 is a cross-sectional view of a midrange loudspeaker driver which starts as a relatively conventional design and is modified with an alternative solution in accordance with the present invention.
Figure 5:
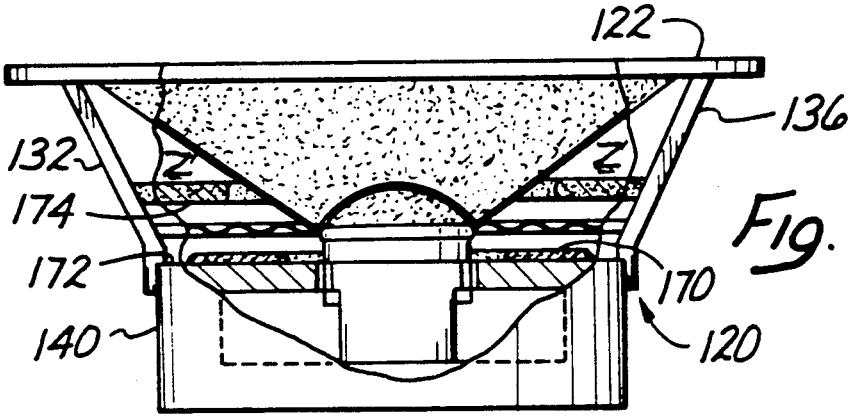
FIG. 5 is a front elevational view taken along the lines 5—5 of the speaker of FIG. 4 illustrating the forward projected area of the diaphragm.
Figure 6:
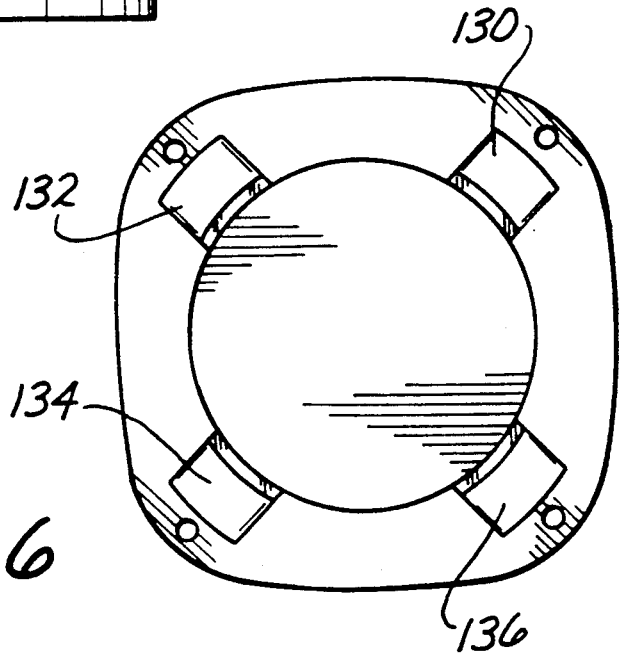
FIG. 6 is a rear elevational view of the driver of FIG. 4 illustrating the rearwardly projected area of the magnet and basket structure in relation to the diaphragm area.

Referring now to FIGS. 4–6 there is shown as alternative structure in which the rear reflected wave from within the driver are eliminated by combining various absorbers and dispersers within the driver structure. Where parts in FIGS. 4–6 have essentially the same function as in FIGS. 1–3, like parts have been given like numbers raised by 100.

Thus, the basket 120, diaphragm 126, and magnet 140 structures are relatively conventional. FIG. 6 illustrates the large projected area of the basket and magnet structure as seen from the diaphragm 126. This reflective area is eliminated or at least reduced in accordance with this embodiment of the invention by incorporating suitable specific absorbing and dispersing means within the driver. Such means can include an acoustic absorbent washer 170 attached to the exposed part of the magnet face 172 and a second acoustic donut 174 mounted on the basket arms 130, 132, 134, 136 and positioned intermediate the magnet face 172 and the diaphragm 126. These are made of materials of high acoustic absorbance and acoustic dispersion so that the rear wave is absorbed, deflected and dispersed in directions away from the diaphragm so as to be at least partly eliminated from direct reflection back to the diaphragm.

Suitable materials for these absorbers include fiberglass and other felted mats, which may be loose, and acoustic foams which are tailored to absorb the midrange of frequencies. The donut 174 is also made of material to absorb the midrange of frequencies, and is shaped as a rounded toroid or annular ring to disperse the rear waves away from the reflection angle back toward the diaphragm.

While it is preferred that the modified structure of FIGS. 1–3 be employed, certain compromises may necessitate the use of some of each of these approaches in appropriate measure. Thus, if the extension of the speaker driver rearward and the modification of the magnet structure cannot be fully realized, the employment of some sound absorber within in the driver, as may be employed, so that the combination creates a substantially reflection free zone Z' within the driver itself.

The present invention has been found especially effective in nearly eliminating rear wave reflections from with in the driver. The enclosure in which the driver is working , if closed or partially closed, should be equipped with sound damping materials as is already known in the art.

This invention has achieved a reduction of the overall reflection area of the basket and magnet structures to well below the 80% (of the diaphragm area) reflective area now usual. Drivers constructed in accordance with this invention have been found to possess significantly greater midrange clarity and transparency of sound.

What is claimed is:

1. A loudspeaker driver for generating sound waves in the mid-range of audio frequencies from an electrical signal thereof, comprising:

a magnetic driver defining a drive motion along a predetermined axis, a diaphragm having a diameter extending laterally across said axis to define a sound generating area. a resilient outer suspension, and a moving coil assembly for receiving said electrical signal, said diaphragm, when driven with said electrical signal, generating sound waves moving in a forward direction for listening and unwanted sound waves propagating in a rearward direction, a rigid basket including a front flange for supporting the diaphragm at the suspension and a rear flange for supporting said magnetic driver without any portion of said basket extending across the front of said diaphragm, said basket including a plurality of arms connecting the front flange and the rear flange for rigidly holding the rear flange in spaced relation away from the front flange, said magnetic driver being mounted to the rear flange at one end and magnetically coupled at the other end to the moving coil assembly, said arms extending rearwardly away from the front flange and diaphragm for a substantial distance before converging toward said rear flange, said arms and said magnetic driver thereby forming an anti-reflection zone within said basket and extending laterally over the rearwardly projected area of the diaphragm and extending rearwardly about a diaphragm diameter from said front flange and diaphragm and within the interior of said loudspeaker in front of said rear flange and arms, which zone prevents forward reflection of rearwardly propagating waves backward and into and through the speaker diaphragm from said zone.

2. The loudspeaker driver as in claim 1 in which the cross-sectional area of said magnetic driver, as seen by the diaphragm, is reduced by constructing the magnetic driver in an elongate shape having a substantially greater depth than width.

3. The loudspeaker driver as in claim 1 in which said arms include portions converging inwardly to the second flange at an angle large enough that rearward propagated sound waves from said diaphragm are not reflected back through any part of said diaphragm.

4. The loudspeaker driver as in claim 1 in which said arms are constructed in solid bar shape to present a minimum, reflection cross-section to rearwardly propagated sound waves.

5. The loudspeaker driver as in claim 4 further in which said arms include first portions extending at substantially right angles to said first flange, and second portions converging from the first portions to the second flange, and reinforcing ribs formed thereon joining the first portions to the second portions.

6. The loudspeaker driver as in claim 1 further including a sound dispersive/absorbent material encircling and surrounding said diaphragm and magnetic driver on the rear side thereof and lying between the diaphragm and the arms of the basket for absorbing and dispersing sound within said anti-reflection zone.

7. The loudspeaker driver as in claim 6 in which said material is a loose felt.

8. The loudspeaker driver as in claim 1 in which said magnetic structure is formed with a reduced radial diameter which is less than 50% of the overall diaphragm diameter.

9. The loudspeaker driver as in claim 1, in which said arms extend rearwardly away from the front flange and diaphragm for a substantial distance before converging toward said rear flange, and further being constructed of small cross-sectional area and solid alloy construction for strength while presenting a low projected area as viewed rearwardly from said diaphragm, and which is constructed at a large angle to direct rearwardly propagating waves away from the diaphragm so that rear waves from the diaphragm impinging upon the arms of the basket structure will be reflected by only a small cross-sectional projected area which are then reflected out of the driver and away from the diaphragm.

10. A loudspeaker driver as in claim 1 further wherein said diaphragm is 5 inches or less in diameter, and wherein the basket and magnetic driver structures considered together equal less than 50% of the rearwardly projected area of said diaphragm.

11. A loudspeaker driver as in claim 1 further in which said flanges and arms are made in a one-piece unitary construction of cast material and further in which said arms are constructed in a non-reentrant shape in cross section.

* * * * *